US008257646B2

(12) United States Patent
Haug et al.

(10) Patent No.: US 8,257,646 B2
(45) Date of Patent: Sep. 4, 2012

(54) COMPONENTS MADE OF STEELS WITH AN ULTRAHIGH CARBON CONTENT AND WITH A REDUCED DENSITY AND HIGH SCALING RESISTANCE

(75) Inventors: Tilmann Haug, Weissenhorn (DE); Wolfgang Kleinekathoefer, Waldstetten (DE); Frédéric Pol, Feldkirch (AT)

(73) Assignee: Daimler AG, Stuttgart (DE)

( * ) Notice: Subject to any disclaimer, the term of this patent is extended or adjusted under 35 U.S.C. 154(b) by 427 days.

(21) Appl. No.: 12/439,548

(22) PCT Filed: Aug. 21, 2007

(86) PCT No.: PCT/EP2007/007349

§ 371 (c)(1), (2), (4) Date: Mar. 2, 2009

(87) PCT Pub. No.: WO2008/028561

PCT Pub. Date: Mar. 13, 2008

(65) Prior Publication Data

US 2010/0021339 A1 Jan. 28, 2010

(30) Foreign Application Priority Data

Sep. 7, 2006 (DE) ..... 10 2006 041 902

(51) Int. Cl.

| | |
|---|---|
| ***C22C 38/18*** | (2006.01) |
| *B21D 31/00* | (2006.01) |
| *C21D 6/00* | (2006.01) |
| *C21D 8/00* | (2006.01) |
| *C22C 38/06* | (2006.01) |

(52) U.S. Cl. ..... 420/79; 72/364; 148/621; 148/654; 420/78

(58) Field of Classification Search ..... 72/364; 148/621, 654; 420/78, 79

See application file for complete search history.

(56) References Cited

U.S. PATENT DOCUMENTS

| | | | | |
|---|---|---|---|---|
| 1,850,953 | A | 3/1932 | Armstrong | |
| 4,769,214 | A * | 9/1988 | Sherby et al. | 420/77 |
| 5,445,685 | A | 8/1995 | Strum et al. | |
| 2007/0107816 | A1 * | 5/2007 | Frommeyer et al. | 148/612 |

FOREIGN PATENT DOCUMENTS

| | | | |
|---|---|---|---|
| DE | 678324 | A | 7/1939 |
| DE | 102005027258 | A1 | 12/2006 |

(Continued)

OTHER PUBLICATIONS

Wang, Baoqi et al: "Design of a spheroidization processing for ultrahigh carbon steels containing Al", Materials and Design, Nov. 1, 2006, pp. 562-568, vol. 28, No. 2, London, GB.

(Continued)

*Primary Examiner* — Jessica L Ward
*Assistant Examiner* — Alexander Polyansky
(74) *Attorney, Agent, or Firm* — Patent Central LLC; Stephan A. Pendorf

(57) ABSTRACT

UHC lightweight structural steel with improved scaling resistance, comprising the composition in % by weight C: 1 to 1.6, Al: 5 to 10, Cr: 0.5 to 3, Si: 0.1 to 2.8, the remainder iron and customary impurities accompanying steel, and a method for producing components hot-formed from this in air, wherein hot-forming temperatures of from 800 to 1050° C. are used, depending on the Si content.

7 Claims, 1 Drawing Sheet

SCALING at 860°C and 910°C of UHC steel with 0.04% Si vs. UHC steel with 0.4% Si

FOREIGN PATENT DOCUMENTS

FR 831996 A 9/1938

OTHER PUBLICATIONS

Tsuzaki, K. et al: "Formation of an (alpha+theta) microduplex structure without thermomechanical processing in superplastic ultrahigh carbon steels", Scripta Materialia, Feb. 19, 1999, pp. 675-681, vol. 40, No. 6, Elsevier, Amsterdam, NL.

Frommeyer, G., et al.: Structural Superplasticity at Higher Strain Rates of Hypereutectoid Fe-5.5AI-1SN-1CR-1.3C Steel Metallurgical and Materials Transactions A, 2005, pp. 295-300, vol. 36A, No. 2, Pittsburgh, PA, USA.

Hensel, A. et al.: "Technologie der Metallformung Eisen-und Nichteisenwerkstoffe", Leipzig, Germany, 1990.

* cited by examiner

COMPONENTS MADE OF STEELS WITH AN ULTRAHIGH CARBON CONTENT AND WITH A REDUCED DENSITY AND HIGH SCALING RESISTANCE

BACKGROUND OF THE INVENTION

1. Field of the Invention

The invention concerns steels with an ultra-high carbon content, or Ultra High Carbon (UHC) steels, of reduced density and high sealing resistance, and the production of components by semi hot-forming.

2. Description of the Related Art

UHC steels have already been known for a long time. They were developed particularly having regard to their superplastic properties. Superplastic forming takes place within a narrow process window of temperature and deformation rate (elongation rate ($\epsilon'$)). During superplastic deformation elongations of a few hundred up to 1000% can be reached. Typical for this are a deformation temperature above around 50% of the melting temperature (ideally in the area of the $\alpha \rightarrow \gamma$ transformation) and a very low deformation rate of about $10^{-2}$ to $10^{-5}$ $s^{-1}$. If the respective optimum temperature and/or deformation rate are exceeded, the structure required for the good mechanical properties is destroyed. The ideal speeds for superplastic deformation is therefore substantially below the limit of industrial acceptability for mass-produced products, which is approximately 0.1/s.

Unalloyed UHC steels, as known for example from U.S. Pat. No. 3,951,697, show only a slight superplastic effect, since the structure is unstable against grain growth. U.S. Pat. No. 4,448,613 describes methods for producing the superplastic structure in UHC steels. The control of the superplastic structure in UHC steels with small amounts of Cr, Mn and Si alloying additions is also described.

In U.S. Pat. No. 4,533,390 it is proposed, in a UHC steel with very high Si content (3 to 7%), to increase the A1 temperature, stabilize the structure against grain growth and improve the superplastic properties by means of alloying additions of Cr, Mo, W, Ti and their combinations. The high Si contents make these steels very brittle under ordinary service conditions.

U.S. Pat. No. 769,214 describes UHC steels with a high fraction of Al (preferably 0.5 to 6.4%). The aim is to produce good superplastic properties, in particular good deformability under superplastic conditions, and resistance to oxidation. To stabilize the structure alloying additions of Cr and/or Mo are made. With an Al fraction higher than 6.4% the hot and cold deformability were found to decrease markedly. The preferred UHC steels have Al contents lower than 6.4%.

The deformability of the material is particularly important for the economy of the forming process. Good deformability means being able to reach a high degree of deformation without damage to the component, low yield stress during deformation, and the lowest possible deformation temperature. Only then can components even of complex shape be produced in a few, inexpensive deformation steps.

Although cold forging (cold extrusion molding) can achieve great dimensional accuracy, good surface quality and high component strength (due to work hardening), it suffers from the disadvantages associated with sometimes much higher necessary deformation forces.

During hot forging (at around 1100° C. to 1250° C.) the materials show high deformation capacity (suitable for components of complex shape), but the dimensional accuracy is poor and the surface quality not as good. A particular disadvantage is the high thermo-mechanical loading of the die and the correspondingly severe die wear. Forming pressures in the high-temperature range, for example at forging temperature, result in high tooling costs since either severe wear takes place or expensive high-temperature dies have to be used. Moreover, for reasons of cost the blanks being deformed are processed in air and thereby damaged by oxidation. In steels this leads for example to scaling. Before the further processing of the components so produced, finish machining has to be carried out at least at the surface. Consequently, near-net-shape production of components is possible only to a very limited extent at such temperatures.

Also very important in the context of mass production, particularly in the automotive industry, is high processing speed in the deformation process. Thus, the very low deformation rates in superplastic forming are not acceptable for the mass production of components.

With the known UHC steels having a low Al content, at the usual deformation temperatures of around 750° to 950° C. considerable scaling is to be feared, which can lead to additional machining costs. These steels are not suitable for lightweight construction.

BRIEF SUMMARY OF THE INVENTION

The purpose of the present invention is to provide a lightweight structural steel which can be processed at temperatures below hot-forging temperatures, in air, at the highest possible deformation rates, and to indicate deformation methods that enable high deformation rates and ensure that the mechanical properties of the steels are compromised as little as possible, and that the thermo-mechanical loading of the shaping tools is as low as possible.

According to the invention this objective is achieved by an ultra-high carbon or UHC lightweight structural steel having improved deformability and scaling resistance, by a method for producing hot-formed components of UHC lightweight structural steels by hot deformation at a temperature of 800° to 980° C. in air, and by a method for producing hot-formed components of UHC lightweight structural steels by hot deformation at a temperature of 8800 to 1050° C. in air.

BRIEF DESCRIPTION OF THE SEVERAL VIEWS OF THE DRAWINGS

The present invention is illustrated by way of example and not limitation in the accompanying drawings in which.

DETAILED DESCRIPTION OF THE INVENTION

Figure 1:
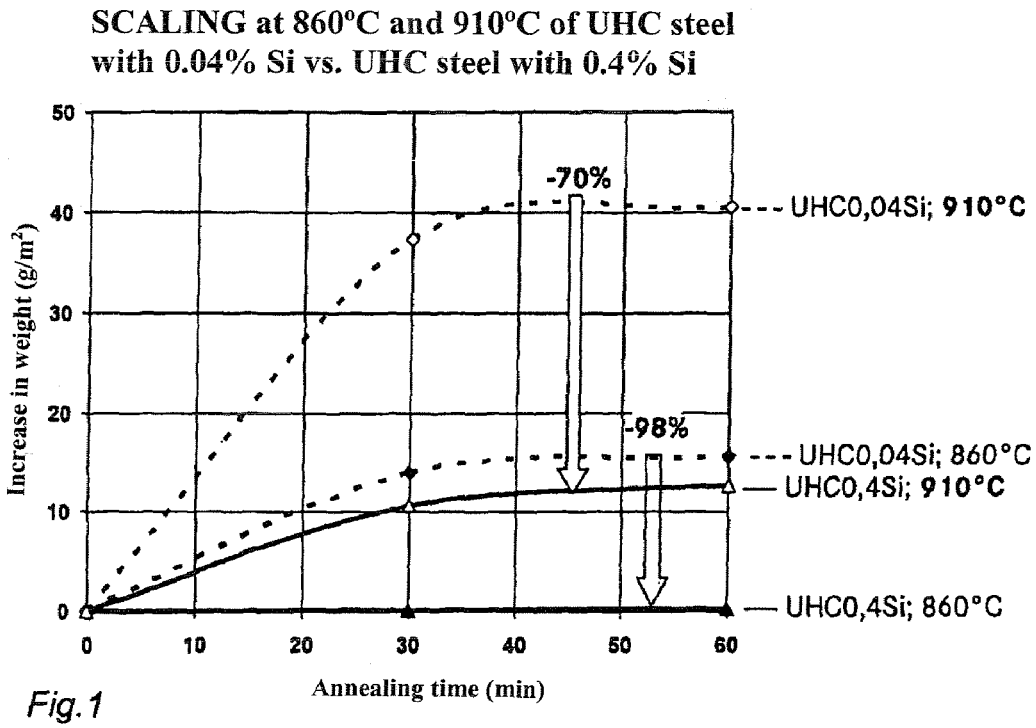
FIG. 1 shows the results of the high-temperature corrosion resistance of the two UHC lightweight structural steels.

In summary, in what follows the deformation process at a temperature in the range of 800° to 1050° C. will be referred to as hot forming.

According to the invention, the following alloy composition is provided for the UHC lightweight structural steel with improved scaling resistance (compositions below given in weight-% unless otherwise indicated):

| | |
|---|---|
| C: | 1 to 1.6 |
| Al: | 5 to 10 |
| Cr: | 0.5 to 3 |
| Si: | 0.1 to 2.8 |

Remainder: iron and the usual impurities found in steels.

Particular importance attaches in this case to the alloying elements Al and Si, which are present together in the UHC lightweight structural steel according to the invention.

Both the Al and the Si contribute towards a significant reduction of the density of the UHC steels. Accordingly, these are lightweight structural steels of particular interest for automotive engineering.

For example, the density of a UHC lightweight structural steel containing 0.4% Si and 6.7% of Al is 7 g/cm$^3$, compared with conventional 25MoCr4 steel whose density is 7.8 g/cm$^3$.

Surprisingly, it has been found that Si can have a considerable influence on the A1 transformation temperature in the given alloy composition. The high Al content substantially increases the Si sensitivity of the alloy. In the Al-containing alloy a slight increase of Si alloying additions already results in a significant increase of the A1 transformation temperature. This means that by adding Si the optimum deformation temperature is raised. The optimum deformation temperature is to be understood in particular as the temperature which allows the highest possible deformation rates without damaging the structure.

For example, in an UHC lightweight structural steel containing 6.5% Al, 1.5% Cr and 1.35% C, and 0.04% Si the A1 transformation temperature is raised from about 820° C. to as much as 865° C. by increasing the Si fraction to only 0.4%.

Raising the A1 transformation temperature displaces the optimum deformation temperature towards higher values while the hot forming temperature level still remains lower than the forging temperature range. This has substantial advantages for hot forming. Since the hot forming process can be carried out at higher temperatures, the yield stress of the UHC lightweight structural steel is reduced. The deformability of the UHC lightweight structural steel at the optimum deformation temperature is improved overall. The hot forging temperatures that affect both components and forming tools adversely are not reached.

Compared with forging steels the mechanical properties at room temperature are distinctly better.

Besides reducing the density, the Al content also has the very important effect of markedly reducing scale formation at hot-forming temperatures. Since only thin scale layers are formed, with which only slight surface finish-machining is needed, the UHC lightweight structural steels according to the invention are particularly suitable also for near-net-shape processes. With UHC lightweight structural steels according to the invention corrosion rate reductions of 92 to 99% are achieved compared with conventional 25MoCr4 steels.

Surprisingly, the Si content too is found to have a significant effect on the reduction of scaling.

The addition of Si preserves the superplastic properties and in some cases a slight increase of deformability at high rates has been detected.

The mechanical properties at room temperature are also not modified disadvantageously by the usually greatly embrittling Si. The UHC lightweight structural steels according to the invention have elongations at fracture only slightly lower compared with Si-free UHC steels.

As a rule during steel production, during melting of the alloy without special precautions Si is taken up by the alloy melt from the furnace lining. For low-Si steel varieties this behavior is problematic and must be suppressed by elaborate and costly measures. In contrast, for the UHC lightweight structural steels according to the invention this Si uptake no longer constitutes a problem since their Si content is in any case high. Thus, inexpensive metallurgical production methods can be used.

It has been shown that the alloying elements Al and Si have a mutually beneficial effect. Thus, the Al/Si ratio is of particular interest. Preferably, an Al/Si ratio between 10 and 20 is chosen. It is particularly preferable for the Al/Si ratio, with an Al content of 6 to 7%, to be 14 to 16.

Since a high Si content worsens the elongation at fracture or increases the brittleness of the steel at room temperature, the Si alloying fraction should be limited to values below around 2.8% for most applications.

The preferred Si content represents a compromise between raising the optimum deformation temperature and affecting the mechanical properties adversely, and is preferably in the range from 0.3 to 1.2 weight-%, and more preferably still from 0.4 to 0.8 weight-%.

Owing to the high contents of Al and Si there is a risk that undesired graphite will be formed in the alloy. This is prevented by adding a suitable amount of Cr, which must be matched to the individual components Si and Al.

A particularly preferred composition, in weight-%, is the following:

| | |
|---|---|
| C: | 1.2 to 1.4 |
| Al: | 5.5 to 7 |
| Cr: | 1 to 2 |
| Si: | 0.3 to 0.6 |

Remainder: iron, and the usual impurities found in steels.

In the context of the alloys according to the invention the said steel-associated impurities may include the typical steel alloy accompanying elements Ni, Mo, Nb and/or V. As a rule, fractions of these elements in an amount below 1% are not critical.

Preferably, the Ni-, Mo-, and/or V-content is lower than 0.15 weight-%. Particularly preferably, at least Ni and/or V are kept to below 0.05%.

In a further embodiment of the invention the UHC lightweight structural steel contains other stabilizing alloying elements chosen from the group Nb, Ti, Mg and/or N. The content of these alloying elements is preferably limited to values lower than 0.8 and preferably lower than 0.5%. Particularly preferably, the sum of these elements is in the range 0.02 to 0.5 weight-%.

It is regarded as a further advantage of the invention that in the UHC lightweight structural steels according to the invention no alloying additions of the extremely expensive alloying elements Ni, Mo and/or V are needed.

After their metallurgical production UHC steels are as a rule not in a structural condition that permits a high deformation rate during hot forming. Typically, a structure ideal for this corresponds to one with superplastic properties. However, for the hot forming process preferred due to economic considerations instead of superplastic deformation, it is as a rule possible to deviate within wide limits from this optimum superplastic structure. What is important, is that a homogeneous, fine-grained, spheroidal carbide distribution stable against grain growth and graphite formation in an also fine-grained ferrite matrix also stable against grain growth is obtained. The grain size of the structure is preferably below 10 μm. Particularly preferably, the mean grain size is below 1.5 μm. Most of the grains should preferably be spheroidal, although small amounts of lamellar carbide can be tolerated for the properties of the UHC steel.

Only by a special thermo-mechanical treatment is a structure formed, which contains the necessary fine crystallites or grains. At least two phases must be formed, which prevent grain growth.

In the compositions according to the invention the phases in question consist essentially of the main phase a-ferrite and subsidiary κ-carbide phases. In this, Al and Si stabilise the structure against grain growth.

To produce this structure a relatively homogeneous pearlite material is first made, which is a lamellar mixture of ferrite and cementite. In a second step this pearlite structure is transformed into a microstructure in which the carbide is present mainly in spheroidal form and the ferrite in ultra-fine grain form.

The structure of the UHC lightweight structural steels preferably contains fine, spheroidal carbides. The mean cross-sectional area of the spheroidal carbides is preferably smaller than 8 $\mu m^2$ and particularly preferably below 3 $\mu m^2$.

Preferably, the volume fraction of the fine spheroidal carbides is around 25 to 30%. The frequency of light-microscopically determinable carbide particles or particles above 500 nm per element of surface area should be greater than 50,000 carbide particles/$mm^2$, preferably greater than 150,000 carbide particles/$mm^2$.

In this context a spheroidal shape is essentially more favourable than carbide particles of lamellar form. Preferably, the mean elongation of the carbide particles is less than 1.8. It is particularly preferable for very rounded particles to be formed, with a mean elongation between 1 and 1.5.

With UHC lightweight structural steels according to the invention the procedure for producing a superplastic structure can be as follows:

A. Largely complete austenitization, depending on the C, Si, Al and Cr content in particular at 1000° to 1150° C. This produces a homogeneous distribution of the carbon and other elements in the coarse γ-phase.

B. Cooling with hot deformation, if necessary with cycling of the temperature within the temperature range of 1100° to 700° C.; this produces spheroidal κ-carbides. The deformation takes place close to the A1 temperature, above and below it. If necessary intermediate annealing can be used to reduce the average cooling rate or to cause the temperature to oscillate either side of the A1 temperature.

C. Air cooling: during this, no more structure transformation takes place.

In step B, typically degrees of deformation in excess of 1.5 are used. Preferably, degrees of deformation of 1.7 to 4 are used.

The UHC lightweight structural steels are preferably used for the production of chassis components, transmission components or gearwheels for motor vehicles. A particularly demanding application is piston rods, which have hitherto not been satisfactorily available as lightweight components.

Other preferred applications are components for motor vehicle combustion engines and transmission components.

Another aspect of the invention relates to methods for the production of hot-formed components from UHC lightweight structural steels.

For the production of components, according to the invention it is envisaged to hot-form an UHC lightweight structural steel of composition (in weight-%):

| | |
|---|---|
| C: | 1 to 1.6 |
| Al: | 5 to 10 |
| Cr: | 0.5 to 3 |
| Si: | 0.1 to 0.8 |

Remainder: iron, and the usual impurities formed in steels at a temperature in the range 800° to 980° C. and in air.

In a further version according to the invention, it is envisaged to hot-form an UHC lightweight structural steel of composition:

| | |
|---|---|
| C: | 1 to 1.6 |
| Al: | 5 to 10 |
| Cr: | 0.5 to 3 |
| Si: | 0.8 to 2.8 |

Remainder: iron, and the usual impurities found in steels at a temperature in the range 880° to 1050° C. in air.

For the hot-forming itself, in principle the various methods known in mechanical engineering for the production of components with complex shapes from metals can be used. Sometimes the cold process has to be appropriately adapted for hot forming. Suitable methods include, among others, hot extrusion molding, cross-rolling, hot spin extrusion, hot squeezing, hot gear rolling, hot upsetting or internal high-pressure forming, as well as forging.

Thanks to their Al and Si contents, the UHC steels mentioned do not need any special protective atmosphere during hot forming, which can therefore be carried out in air.

The temperatures at which hot forming is carried out in the context of the invention are substantially lower than the forging temperature for the alloy concerned. These comparatively lower temperatures have a further important advantage for the forming tools. Often, conventional steel tools can be used instead of the otherwise necessary high-temperature tools.

UHC lightweight structural steels are preferably hot formed at a process pressure below 150 to 180 MPa and at a deformation rate or strain rate ($\epsilon'$=relative length change/initial length per unit time) above 0.1/s. The design of the process can be optimized in relation to process pressure or high deformation rate, depending on the deformation process or forming tool chosen. Particularly preferred deformation rates are above 0.5/s.

If UHC lightweight structural steels with a superplastic structure are used, then very high degrees of deformation can be achieved even under the non-superplastic conditions of hot forming. Preferably, during hot forming, blank elongations in the range 50 to 300% are produced.

As a rule, with the methods according to the invention no, or at least substantially fewer subsequent machining steps are needed even for complex components, which also makes for better utilization of the material. Likewise, several successive deformation processes can sometimes be combined into a single forming process according to the invention. With the UHC lightweight structural steels according to the invention the scaling that accumulates over several hot processes is comparatively slight. The process chain for producing the finished component is advantageously made shorter.

It is particularly preferable, after hot forming the UHC lightweight structural steel, to carry out no surface finish-machining to remove the scale layer.

In a preferred manner, the process according to the invention is carried out as a near-net-shape process so that after forming, the component is obtained in as nearly a ready-to-use condition as possible and finish machining need only be carried out if necessary on particular functional surfaces. The cleaning and polishing of the surfaces are considerably easier than with the known steels.

The UHC lightweight structural steels according to the invention also show good hardenability (up to >60 HRC without case hardening).

Preferably after hot forming a hardening process takes place. In particular, this is done directly with the process heat of the forming process and by air quenching. Tempering can then be carried out in a known manner. For such tempered UHC lightweight structural steels, at room temperature tensile strengths of 1500 MPa with an elongation of 8% have been measured.

EXAMPLES

In the following example the properties of an almost Si-free UHC lightweight structural steel, a conventional steel and an UHC lightweight structural steel according to the invention are compared (see Table 1).

For the UHC steels the Al and Cr contents and the degree of deformation during processing were kept essentially the same, and the Si content was increased from 0.039% (UHC steel Si 0.04) to 0.38% (UHC steel Si 0.4).

Compared with 25MoCr4 there is a substantial density reduction with comparatively better high-temperature properties; the tensile strength and elongation at fracture at 910° C. are considerably higher.

The comparison between UHC steel Si 0.04 and UHC steel Si 0.4 shows that the addition of Si has a distinctly favorable influence on the A1 transformation temperature, which increases from 805° to 865° C. The density is also reduced further, from 7.11 g/cm$^3$ to 7.01 g/cm$^3$. The embrittlement, characterised by a reduction of the elongation at fracture from 12.4 to 6.5% still remains acceptable.

TABLE 1

| | UHC Steel Si0.04 | UHC Steel Si0.4 | Reference 25 MoCr 4 Coarse-grain annealed |
|---|---|---|---|
| Si fraction | 0.039 weight-% Si | 0.380 weight-% Si | — |
| Al fraction | 6.49 weight-% Al | 6.72 weight-% Al | — |
| C fraction | 1.35 weight-% C | 1.32 weight-% C | |
| Cr fraction | 1.57 weight-% Cr | 1.54 weight-% Cr | |
| Preparation degree of deformation | $\phi_H = 1.7$ | $\phi_H = 1.6$ | — |
| BASIC PROPERTIES | | | |
| Density | 7.11 g/cm$^3$ | 7.01 g/cm$^3$ | 7.83 g/cm$^3$ |
| Young's modulus | 209.0 GPa | — | 209.9 GPa |
| Microhardness | 301.0 HV30 | 311.0 HV30 | 252.0 HV30 |
| Macrohardness | 29.6 HRC | 27.8 HRC | 24.4 HRC |
| STRUCTURE | | | |
| Description | Fine spheroidal carbides | Coarse spheroidal carbides | — |
| Statistic | | | |
| Volume fraction of carbide particles | 20.4% | 26.7% | — |
| Number of carbide particles | 141,000/mm$^2$ | 69,000/mm$^2$ | — |
| Size | | | |
| Mean area of carbide particles | 1.4 μm$^2$ | 3.9 μm$^2$ | — |
| Mean extension of carbide particles | 1.9 μm | 2.9 μm | — |
| Shape | | | |
| Mean elongation of carbide particles | 1.80 | 1.76 | — |
| PHASE TRANSFORMATION | | | |
| Start (Ac1) | Approx. 820° C. | Approx. 865° C. | — |
| End (Acm) | Approx. 905° C. | Approx. 1000° C. | — |
| RT PROPERTIES | | | |
| Yield point | 698 MPa | 67698 MPa | — |
| Tensile strength | 934 MPa | >940 MPa | — |
| Elongation at fracture | 12.4% | 6.5% | — |
| HT PROPERTIES | | | 25 MoCr 4 cold shearing |
| 910° C. - 1.0/s | | | |
| Tensile strength | 172 MPa | 215 MPa | 144 MPa |
| Elongation at fracture | 74% | 102% | 60% |

FIG. 1 shows the results of the high-temperature corrosion resistance of the two UHC lightweight structural steels. The figure shows the scaling at 860° C. and 910° C. on the UHC steel with 0.04% Si compared with that on the UHC steel with 0.4% Si (UHC Si 0.04 versus UHC Si 0.4).

On specimens measuring 100×20×3 mm the scaling in air for up to 60 minutes was measured at 800° C. and 910° C. Here, weight increase is the essential measure of scale formation.

The Si content has a significant influence on the reduction of scaling. At 910° C. changing from 0.04 to 0.4% Si reduces the scaling by 70%. At the temperature of 860° C. particularly relevant for hot forming the relative reduction of scaling is even as much as 98%.

Figure 2:
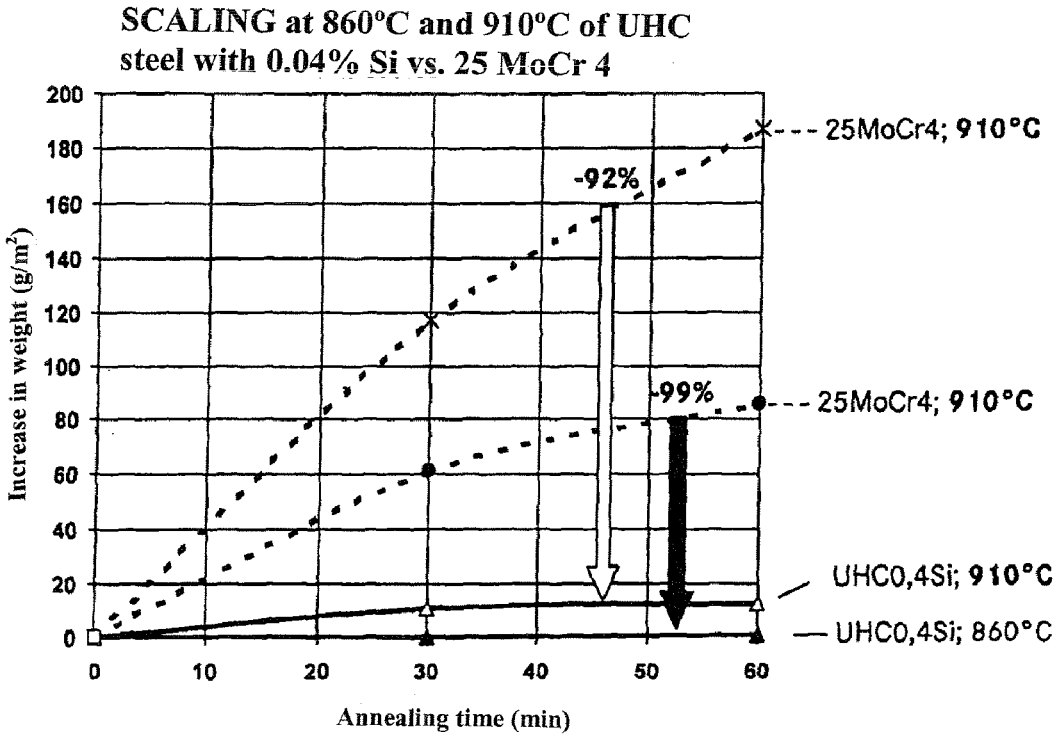
FIG. 2 shows comparative tests between UHC0,4Si and 25MoCr4.

Comparative tests between UHC0.4Si and 25MoCr4 are shown in FIG. 2. Compared with UHC0.4Si, at both temperatures 25MoCr4 shows scaling higher by 92 to 99%.

The invention claimed is:

1. A UHC lightweight structural steel with improved scaling resistance, having a composition consisting of, in weight-%

| | |
|---|---|
| C: | 1 to 1.6 |
| Al: | 5 to 10 |
| Cr: | 0.5 to 3 |
| Si: | 0.1 to 2.8 |

wherein the UHC lightweight structural steel optionally contains stabilizing alloying elements chosen from the group consisting of Nb, Ti, Mg and N in an amount of 0.02 weight-% to less than 0.8 weight-%, and remainder: iron with the usual impurities formed in steels, wherein any impurity element is present in an amount of less than 1 weight-%.

2. The UHC lightweight structural steel according to claim 1, wherein Al and Si are present in a ratio of between 10:1 and 20:1.

3. The UHC lightweight structural steel according to claim 1, consisting of, in weight-%

| | |
|---|---|
| C: | 1.2 to 1.4 |
| Al: | 5.5 to 7.0 |
| Cr: | 1.0 to 2.0 |
| Si: | 0.3 to 0.6 |

wherein the UHC lightweight structural steel optionally contains stabilizing alloying elements chosen from the group consisting of Nb, Ti, Mg and N in an amount of 0.02 weight-% to less than 0.8 weight-%, and remainder: iron with the usual impurities formed in steels, wherein any impurity element is present in an amount of less than 1 weight-%.

4. The UHC lightweight structural steel according to claim 1, wherein the impurities are selected from the group consisting of Ni, Mo and V and wherein the content of said respective impurities is below 0.15 weight-%.

5. The UHC lightweight structural steel according to claim 1, wherein the steel structure contains the stabilizing alloying elements, and contains fine, spheroidal carbides with average cross-sectional areas smaller than 8 $\mu^2$.

6. The UHC lightweight structural steel according to claim 5, wherein the steel contains fine spheroidal carbides in a volume fraction of 25 to 30%.

7. The UHC lightweight structural steel according to claim 4, wherein the Ni and V respectively are below 0.05 weight-%.

* * * * *